US008322823B2

(12) United States Patent
Owaki

(10) Patent No.: US 8,322,823 B2
(45) Date of Patent: Dec. 4, 2012

(54) LIQUID EJECTING HEAD, MANUFACTURING METHOD THEREOF, AND LIQUID EJECTING APPARATUS

(75) Inventor: Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 188 days.

(21) Appl. No.: 12/831,402

(22) Filed: Jul. 7, 2010

(65) Prior Publication Data

US 2011/0018943 A1 Jan. 27, 2011

(30) Foreign Application Priority Data

Jul. 24, 2009 (JP) ..... 2009-172865

(51) Int. Cl.
*B41J 2/14* (2006.01)
*B41J 2/045* (2006.01)

(52) U.S. Cl. ..... 347/50; 347/70

(58) Field of Classification Search ..... None
See application file for complete search history.

(56) References Cited

U.S. PATENT DOCUMENTS

| | | | | |
|---|---|---|---|---|
| 6,729,716 | B2 * | 5/2004 | Eguchi et al. | 347/70 |
| 7,152,963 | B2 | 12/2006 | Owaki et al. | |
| 2007/0046727 | A1 * | 3/2007 | Yanagisawa et al. | 347/47 |
| 2007/0263041 | A1 | 11/2007 | Owaki | |

FOREIGN PATENT DOCUMENTS

| | | |
|---|---|---|
| JP | 2005-053079 | 3/2005 |
| JP | 2006-281477 | 10/2006 |
| JP | 2007-053136 | 3/2007 |
| JP | 2007-062312 | 3/2007 |
| JP | 2007-069445 | 3/2007 |
| JP | 2007-301736 | 11/2007 |
| JP | 2008-023799 | 2/2008 |

* cited by examiner

*Primary Examiner* — Geoffrey Mruk
(74) *Attorney, Agent, or Firm* — Workman Nydegger

(57) ABSTRACT

A liquid ejecting head includes: a flow path forming substrate; an actuator device having a plurality of mounting portions provided on the flow path forming substrate; a wiring substrate which has flexibility and is electrically connected to the mounting portions to supply a driving signal to the actuator device; and a protective substrate provided on the mounting portions side of the flow path forming substrate, wherein a plurality of through-holes, into which the wiring substrate can be inserted, is provided in the protective substrate, a partition wall partitioning the mounting portions is provided between at least adjacent through-holes, and resin is provided in the through-holes.

8 Claims, 8 Drawing Sheets

LIQUID EJECTING HEAD, MANUFACTURING METHOD THEREOF, AND LIQUID EJECTING APPARATUS

The entire disclosure of Japanese Patent Application No. 2009-172865 filed Jul. 24, 2009 is expressly incorporated by reference herein.

BACKGROUND

1. Technical Field

The present invention relates to a liquid ejecting head which ejects liquid from nozzle orifices, a manufacturing method of the liquid ejecting head, and a liquid ejecting apparatus.

2. Related Art

Among liquid ejecting heads which eject liquid, there is known an ink jet type recording head, in which piezoelectric elements are provided on one face side of a flow path forming substrate, in which pressure generation chambers that are communicated with nozzle orifices are provided, and ink droplets are discharged from the nozzle orifice by making a pressure change occur in the pressure generation chamber in accordance with displacement of the piezoelectric element.

As the ink jet type recording head, there is proposed a recording head configured such that a protective substrate is joined on the piezoelectric element side of a flow path forming substrate, each terminal of a driving circuit provided on the protective substrate is electrically connected to each piezoelectric element by a bonding wire by using wire bonding, and a driving signal from the driving circuit is supplied to the piezoelectric element through the bonding wire (refer to, for example, JP-A-2005-053079, JP-A-2007-301736, and JP-A-2008-023799).

Also, as the ink jet type recording head, there is proposed a recording head, in which a COF substrate which supplies a driving signal is connected to a plurality of piezoelectric elements (refer to, for example, JP-A-2006-281477).

However, if each terminal of the driving circuit is individually connected to each piezoelectric element by wire bonding, the wire bonding must be carried out for as many as the number of piezoelectric elements, so that there is a problem in that manufacturing time and costs increase.

Also, a region for disposing the terminal, to which the bonding wire is connected, needs to be provided at the piezoelectric element, so that there is a problem that the head increases in size.

In addition, as in JP-A-2007-301736, there is also proposed a recording head, in which a piezoelectric element is electrically connected by using a COF substrate. However, in a case where a row of the piezoelectric elements arranged in parallel is provided in plural rows, there is a problem in that the resin material, such as an anisotropic electrically-conductive adhesive or a potting agent, which is used for the connection of the COF substrate and the piezoelectric elements, flows out in between the rows of the piezoelectric elements, so that there is fear that electrical conduction defects may occur. In addition, if the distance between the rows of piezoelectric elements is widened in order to suppress electrical conduction defects due to the overflowing resin, head increases in size.

Also, such a problem exists not only for ink jet type recording heads, but also for liquid ejecting heads ejecting liquid other than ink.

SUMMARY

An advantage of some aspects of the invention is that it provides a liquid ejecting head, in which a wiring substrate and an actuator device are reliably electrically connected to each other, so that cost and size reductions for the head can be achieved, a manufacturing method of the liquid ejecting head, and a liquid ejecting apparatus.

According to a first aspect of the invention, there is provided a liquid ejecting head including: a flow path forming substrate; an actuator device having a plurality of mounting portions provided on the flow path forming substrate; a wiring substrate which has flexibility and is electrically connected to the mounting portions to supply a driving signal to the actuator device; and a protective substrate provided on the mounting portions side of the flow path forming substrate, wherein a plurality of through-holes, into which the wiring substrate can be inserted, is provided in the protective substrate, a partition wall partitioning the mounting portions is provided between at least adjacent through-holes, and resin is provided in the through-holes.

In this aspect, since in adjacent through-holes, the outflow of resin in one through-hole into the other through-hole can be regulated by the partition wall, it is possible to closely dispose the mounting portions by making positions of adjacent through-holes close to each other. Therefore, a reduction in size of the head can be achieved. Also, it is not necessary to reduce the amount of resin in order to suppress overflow of resin, so that occurrence of trouble such as a protection defect or a connection defect can be suppressed.

Here, it is preferable that individual flow paths be provided at the flow path forming substrate and a manifold which is communicated with a plurality of individual flow paths be provided on the opposite side to the flow path forming substrate of the actuator device. According to this, it is possible to achieve a further reduction in size of the head, and also, it is possible to mount the driving circuit on the actuator device by the wring substrate even without disposing a driving IC on the manifold.

Also, it is preferable that the resin be an anisotropic electrically-conductive adhesive having anisotropic conductivity. According to this, since the mounting (electrical connection) of the wiring substrate and the mounting portions can be easily performed through the anisotropic electrically-conductive adhesive, and also the outflow of the anisotropic electrically-conductive adhesive can be suppressed by the partition wall, the mounting of the wiring substrate and the mounting portions can be reliably performed by using the needed amount of anisotropic electrically-conductive adhesive.

Also, the resin may also be a potting agent. According to this, peeling of the wiring substrate from the mounting portions due to factors such as vibration can be suppressed, and also short-circuits between the wirings due to foreign matter can be suppressed.

Also, according to a second aspect of the invention, there is provided a liquid ejecting apparatus including the liquid ejecting head according to the above-described aspect.

In this aspect, a liquid ejecting apparatus, in which costs and size are reduced, can be realized.

Also, according to a third aspect of the invention, there is provided a method of manufacturing a liquid ejecting head which includes a flow path forming substrate; an actuator device having a plurality of mounting portions provided on the flow path forming substrate; a wiring substrate which has flexibility and is electrically connected to the mounting portions to supply a driving signal to the actuator device; and a protective substrate provided on the mounting portions side of the flow path forming substrate, wherein a plurality of through-holes, into which the wiring substrate can be inserted, is provided in the protective substrate, a partition wall partitioning the mounting portions is provided between at least adjacent through-holes, and resin is provided in the through-holes, the method including: a process for mounting the wiring substrate on the mounting portions provided in each through-hole, and also filling the through-hole with resin, and the process being sequentially carried out for each through-hole.

In this aspect, since in adjacent through-holes, outflow of resin in one through-hole into the other through-hole can be regulated by the partition wall, it is possible to closely dispose the mounting portions by making positions of adjacent through-holes close to each other. Therefore, a reduction in size of the head can be achieved. Also, it is not necessary to reduce the amount of resin in order to suppress overflow of resin, so that occurrence of trouble such as protection defects or connection defects can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be explained in detail on the basis of embodiments.

Embodiment 1

Figure 1:
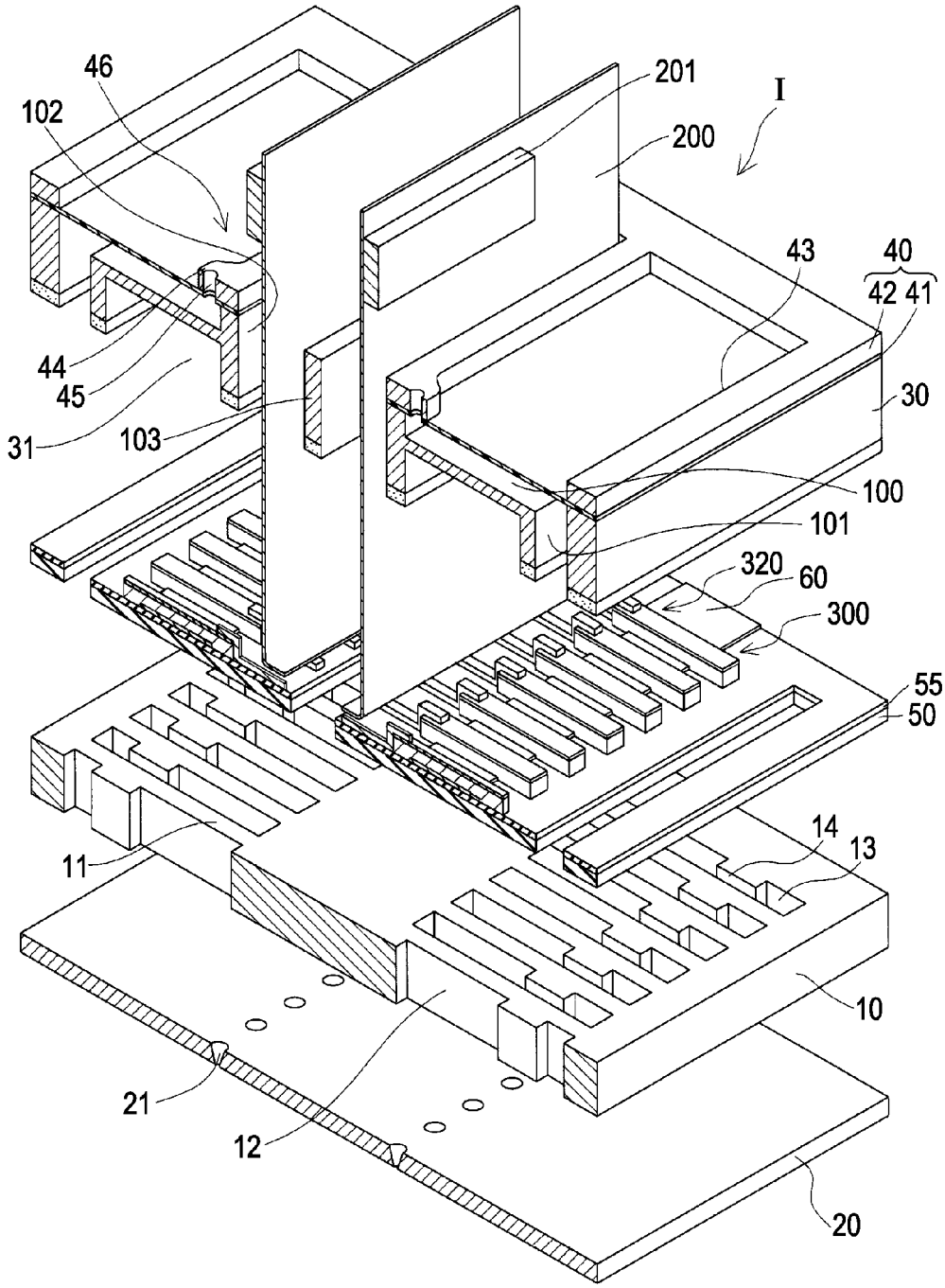
FIG. 1 is an exploded perspective view of a recording head related to Embodiment 1 of the invention.
Figure 2A:
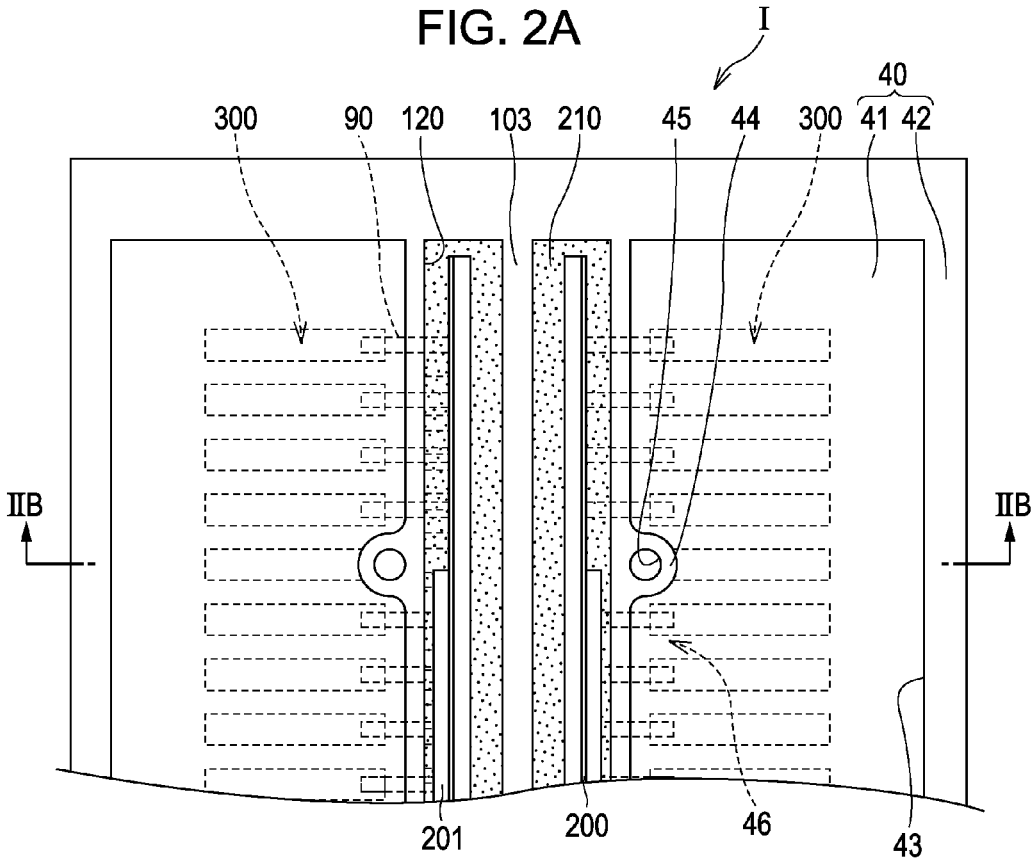
FIGS. 2A and 2B are a plan view and a cross-sectional view of the recording head related to Embodiment 1 of the invention.
Figure 2B:
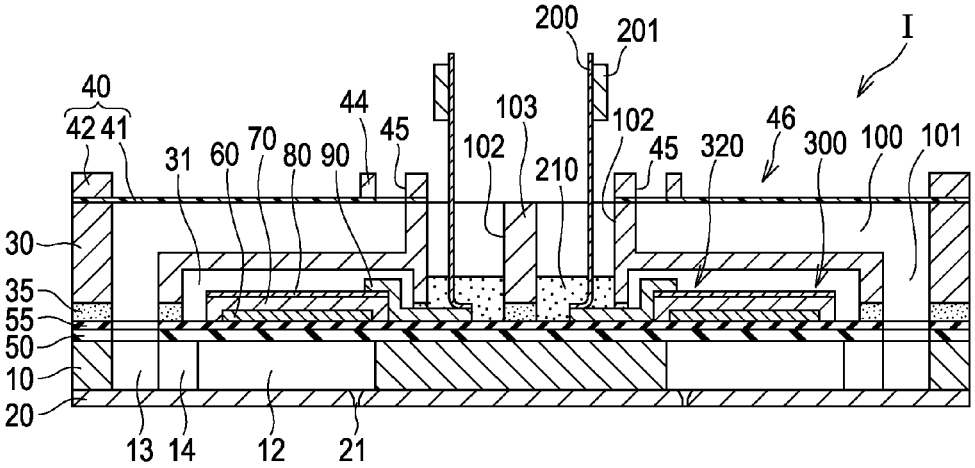

FIG. 1 is an exploded perspective view showing an ink jet type recording head which is one example of a liquid ejecting head related to Embodiment 1 of the invention, and FIGS. 2A and 2B are a plan view of FIG. 1 and a cross-sectional view taken along line IIB-IIB of FIG. 2A.

As shown in the drawings, a flow path forming substrate 10 is made of, in this embodiment, a silicon single crystal substrate, and on one face thereof, an elastic film 50 made of silicon dioxide is formed.

At the flow path forming substrate 10, by performing anisotropic etching from the other face side thereof, a row of pressure generation chambers 12, which are partitioned by a plurality of wall portions 11 and arranged in parallel in the width direction (short side direction) thereof, is provided two rows in the longitudinal direction of the pressure generation chamber 12. Also, on one end side in the longitudinal direction of the pressure generation chamber 12 of the flow path forming substrate 10, an ink supply path 14 and a communication path 13, which are one example of a liquid supply path that constitutes an individual flow path for every nozzle orifice, which will be described in detail later, along with the pressure generation chamber 12, are partitioned by the wall portion 11. The ink supply path 14 and the communication path 13 are disposed outside two rows of the pressure generation chambers 12 in each row of the pressure generation chambers 12.

The ink supply path 14 is to make flow path resistance occur in ink between a manifold 100, which will be described in detail later, and the pressure generation chamber 12, is communicated with one end portion side in the longitudinal direction of the pressure generation chamber 12, and has a smaller cross-sectional area than the cross-sectional area of the pressure generation chamber 12. For example, in this embodiment, the ink supply path 14 is formed into a smaller width than the width of the pressure generation chamber 12 by narrowing in the width direction the flow path of the pressure generation chamber 12. In addition, in this manner, in this embodiment, the ink supply path 14 is formed by narrowing the width of the flow path from one side. However, the ink supply path may also be formed by narrowing the width of the flow path from both sides. Also, the ink supply path may also be formed by narrowing in the thickness direction without narrowing the width of the flow path. Further, each communication path 13 is communicated with the opposite side to the pressure generation chamber 12 of the ink supply path 14 and has a larger cross-sectional area than the width direction (short side direction) of the ink supply path 14. In this embodiment, the communication path 13 is formed to have the same cross-sectional area as that of the pressure generation chamber 12.

That is, at the flow path forming substrate 10, a row of individual flow paths which are partitioned and provided by a plurality of the wall portions 11 is provided two rows, and the individual flow path is composed of the pressure generation chamber 12, the ink supply path 14 having a smaller cross-sectional area than the cross-sectional area in a short side direction of the pressure generation chamber 12, and the communication path 13 which is communicated with the ink supply path 14 and has a larger cross-sectional area than the cross-sectional area in a short side direction of the ink supply path 14.

To the face side, at which the individual flow path including the pressure generation chamber 12 is opened, of the flow path forming substrate 10, a nozzle plate 20 is fixed by an adhesive, a heat welding film, or the like, and the nozzle plate 20 is one example of a nozzle forming member, in which nozzle orifices 21 each communicated with the vicinity of an end portion on the opposite side to the ink supply path 14 of each pressure generation chamber 12 are perforated. In addition, the nozzle plate 20 is made of, for example, glass ceramics, silicon single crystal substrate, stainless steel, or the like.

On the other hand, as described above, the elastic film 50 is formed on the face on the opposite side to the nozzle plate 20 of such a flow path forming substrate 10, and an insulator film 55 is formed on the elastic film 50. Further, a first electrode 60, a piezoelectric body layer 70, and a second electrode 80 are laminated and formed on the insulator film 55 in a process, which will be described later, thereby constituting a piezoelectric element 300. Here, the piezoelectric element 300 means a portion which includes the first electrode 60, the piezoelectric body layer 70, and the second electrode 80. In general, any one electrode of the piezoelectric element 300 is made to be a common electrode, and the other electrode and the piezoelectric body layer 70 are constituted by patterning for every pressure generation chamber 12. In this embodiment, the first electrode 60 is set to be a common electrode to the piezoelectric elements 300, and the second electrode 80 is set to be an individual electrode of the piezoelectric element 300. However, the arrangement may be reversed in accordance with the conditions of a driving circuit or a wiring. That is, in this embodiment, a configuration is made such that the piezoelectric element 300 is provided as an actuator device which makes a pressure change occur in the ink (liquid) in the pressure generation chamber 12.

Also, a lead electrode 90 made of gold (Au) or the like and provided to extend up to the vicinity of an end portion on the opposite side to the ink supply path 14 of the flow path forming substrate 10 is connected to the second electrode 80 of each piezoelectric element 300. Voltage is selectively applied to each piezoelectric element 300 through the lead electrode 90. That is, in this embodiment, an end portion on the opposite side to the piezoelectric element 300 of the lead electrode 90 becomes a mounting portion, to which a wiring substrate, which will be described in detail later, is electrically connected.

Also, a protective substrate 30 having a piezoelectric element retention portion 31, which has a space of an extent that does not hinder the movement of the piezoelectric elements 300, at a region facing the piezoelectric elements 300 is joined to the flow path forming substrate 10, on which the piezoelectric elements 300 are formed, by an adhesive 35 or the like. Since the piezoelectric elements 300 are disposed in the piezoelectric element retention portion 31, the piezoelectric elements are protected in a state where they are almost unaffected by external environment. In addition, the piezoelectric element retention portion 31 may or may not be hermetically sealed. Also, the piezoelectric element retention portion 31 may also be independently provided for every piezoelectric element 300 or continuously provided over a plurality of piezoelectric elements 300. In this embodiment, the piezoelectric element retention portion 31 is continuously provided over a plurality of piezoelectric elements 300.

Further, the manifold 100 which serves as a common ink chamber (liquid chamber) to a plurality of individual flow paths is provided at a region opposite to the piezoelectric element retention portion 31 on the protective substrate 30. In this embodiment, the manifold 100 is formed as being a concave portion provided at a face on the opposite side to a joining face of the protective substrate 30 to the flow path forming substrate 10. That is, the manifold 100 is opened to the opposite side to the flow path forming substrate 10 of the protective substrate 30, and the opening of the manifold 100 is sealed by a compliance substrate 40, which will be described in detail later. In addition, the manifold 100 is continuously provided over the short side direction (width direction) of a plurality of individual flow paths. Also, the manifold 100 is provided up to the vicinity of both end portions of the protective substrate 30 in the longitudinal direction of the pressure generation chamber 12, and one end portion side of the manifold 100 is provided up to a region facing an end portion of the individual flow path. In this manner, by providing the manifold 100 above the piezoelectric element retention portion 31 (at a region overlapping with the piezoelectric element retention portion 31 in a plan view), the manifold 100 does not need to be widened outward in the longitudinal direction of the pressure generation chamber 12, so that the width in the longitudinal direction of the pressure generation chamber 12 of the ink jet type recording head I can be reduced, thereby resulting in a reduction in size.

Also, in the protective substrate 30, a supply portion 101 is provided which is a through-hole that penetrates in the thickness direction and is communicated at one end with an end portion of the communication path 13, which constitutes an individual flow path, and at the other end with one end portion of the manifold 100. In this embodiment, the supply portion 101 is provided one over a plurality of communication paths 13 which constitute individual flow paths. Then, ink from the manifold 100 is supplied to the communication path 13, the ink supply path 14, and the pressure generation chamber 12, which constitute each individual flow path, through the supply portion 101. That is, in this embodiment, the supply portion 101 also functions as a part of the manifold 100.

As a material of such a protective substrate 30, glass, a ceramic material, metal, resin, or the like can be given as example. However, it is preferable that the protective substrate be formed of a material having approximately the same coefficient of thermal expansion as that of the flow path forming substrate 10, and in this embodiment, silicon single crystal substrate which is the same material as the flow path forming substrate 10 is used.

Also, in the protective substrate 30, a through-hole 102 which penetrates in the thickness direction is provided at a region corresponding to a region between two rows of the pressure generation chambers 12. A wiring substrate 200 is inserted into the through-hole 102, so that the wiring substrate 200 and the mounting portion of the actuator device are electrically connected to each other. Here, in this embodiment, the actuator device is the piezoelectric element 300, and the lead electrode 90 connected to the piezoelectric element 300 is provided at a position where the end portion thereof is disposed in the through-hole 102.

Also, the through-hole 102 is provided one for each row of the piezoelectric elements 300. That is, in this embodiment, since the wiring substrate 200 is connected for every row of the piezoelectric elements 300 and the rows of the piezoelectric elements 300 are two rows, two through-holes 102 are provided. Then, a partition wall 103 partitioning the mounting portions (end portions of the lead electrodes 90) is provided between adjacent through-holes 102.

The wiring substrate 200 is electrically connected to end portions of the lead electrodes 90, which are exposed in the through-hole 102. The wiring substrate 200 is a flexible substrate, in which a driving circuit 201 for driving the piezoelectric elements 300 is mounted on wirings (not shown), and, for example, a flexible printed circuit board (FPC) such as a chip on film (COF) or a tape carrier package (TCP) can be used.

The wiring substrate 200 and the lead electrode 90 which is the mounting portion of the actuator device can be electrically connected to each other through, for example, solder or an anisotropic electrically-conductive adhesive (ACP). In this embodiment, a configuration is made such that the wiring substrate 200 and the lead electrode 90 are electrically connected to each other through an anisotropic electrically-conductive adhesive 210. Also, the anisotropic electrically-conductive adhesive 210 electrically connects the wiring substrate 200 and the lead electrode 90, and also functions as an adhesive which fixes the wiring substrate 200 in the through-hole 102. Therefore, the anisotropic electrically-conductive adhesive 210 fills in the through-hole 102, and the anisotropic electrically-conductive adhesive 210 of this embodiment corresponds to resin which fills in the through-hole 102, as defined in the claims.

In such a configuration, since two through-holes 102 are partitioned by the partition wall 103, when the wiring substrate 200 and the lead electrode 90 are connected to each other through the anisotropic electrically-conductive adhesive 210 in one through-hole 102, the outflow of the anisotropic electrically-conductive adhesive 210 into the other through-hole 102 can be suppressed by the partition wall 103. Therefore, it is not necessary to dispose apart the positions of adjacent mounting portions in order to suppress the outflow of the anisotropic electrically-conductive adhesive 210, and it is possible to realize a reduction in the size of the ink jet type recording head I by closely disposing adjacent mounting portions. Also, it is not necessary to reduce the coating amount of the anisotropic electrically-conductive adhesive 210 in order to suppress the outflow of the anisotropic electrically-conductive adhesive 210, and it is possible to suppress occurrence of trouble such as poor electrical-connection or a reduction in bonding strength due to a low amount of the anisotropic electrically-conductive adhesive 210. In addition, since it is possible to connect a plurality of lead electrodes 90 to one wiring substrate 200 by using the anisotropic electrically-conductive adhesive 210, working hours can be shortened compared to the sequential connection of the respective lead electrodes 90 by wire bonding, thereby resulting in a reduction in costs. Of course, although the details will be described later, even in a case where the wiring substrate 200 and a plurality of lead electrodes 90 are connected to each other by metal such as solder, it is possible to connect simultaneously a plurality of lead electrodes 90 to the wiring substrate 200, so that the same effect is presented.

Also, the compliance substrate 40 which is composed of a sealing film 41 and a fixing plate 42 is joined on the face side, where the manifold 100 is opened, of the protective substrate 30, so that the opening of the manifold 100 is sealed by the compliance substrate 40.

The sealing film 41 is made of a material low in rigidity and having flexibility, for example, a polyphenylene sulfide (PPS) film or the like having a thickness of the order of several μm.

Also, the fixing plate 42 is made of a hard material, for example, metal such as stainless steel (SUS) having a thickness of the order of several tens of μm. As shown in FIGS. 2A and 2B, the fixing plate 42 is provided over the periphery of the manifold 100 of the protective substrate 30, and a region thereof facing the manifold 100 is completely removed in the thickness direction, thereby forming an opening portion 43. Also, a protrusion portion 44 which protrudes to the opening portion 43 side is provided at the fixing plate 42, and at the protrusion portion 44, an introduction path 45 is provided which penetrates in the thickness direction and is for supplying ink from a storage means (not shown), in which ink is stored, to the manifold. In this embodiment, the protrusion portion 44 is provided on the opposite side to the supply portion 101 and protrudes up to a region where a part of the juxtaposing direction of the pressure generation chambers 12 faces the manifold 100. Therefore, the introduction path 45 is made to be provided at the end portion on the opposite side to the supply portion 101 provided in the protective substrate 30, in the longitudinal direction of the pressure generation chamber 12. In this manner, the introduction path 45 is provided at an end portion on the opposite side to the supply portion 101 of the protective substrate 30, so that the influence of the dynamic pressure of ink which is introduced from the storage means on the pressure generation chamber 12 through the supply portion 101 can be reduced.

Also, due to the opening portion 43 of the fixing plate 42, one face of the manifold 100 becomes a flexible portion 46 which is flexural-deformable and sealed only by the sealing film 41 having flexibility. That is, in this embodiment, the flexible portion 46 is provided at a region facing the supply portion 101 of the protective substrate 30 of a region facing the manifold 100, and the periphery of the introduction path 45 of the fixing plate 42 of a region facing the manifold 100. The flexible portion 46 is continuously provided over a region facing the supply portion 101 and the periphery of the introduction path 45. In this manner, by continuously providing the flexible portion 46 over a region facing the supply portion 101 and the periphery of the introduction path 45, the flexible portion 46 can be formed into a wide area, so that compliance in the manifold 100 is increased, whereby occurrence of cross-talk due to adverse effects of a pressure change can be reliably reduced.

Also, in this embodiment, since a configuration is made such that the wiring substrate 200, on which the driving circuit 201 is mounted, is connected to the lead electrodes 90, it is not necessary to mount the driving circuit 201 on the protective substrate 30. Therefore, it is possible to widen the manifold 100 above the piezoelectric element retention portion 31, and also to provide the compliance substrate 40 having the wide flexible portion 46 above the protective substrate 30.

In such an ink jet type recording head of this embodiment, ink is introduced from an external storage means (not shown), in which ink is stored, into the manifold 100, and then the inside from the manifold 100 down to the nozzle orifices 21 through the supply portion 101 is filled with the ink. Thereafter, according to a recording signal from the driving circuit 201, voltage is applied between the first electrode 60 and the second electrode 80, which correspond to each pressure generation chamber 12, thereby causing flexural deformation of the piezoelectric element 300 and a vibration plate, so that pressure in each pressure generation chamber 12 is increased, thereby discharging ink from the nozzle orifice 21.

Hereinafter, a method of manufacturing such an ink jet type recording head will be explained with reference to FIGS. 3A to 6B.

Figure 3A:
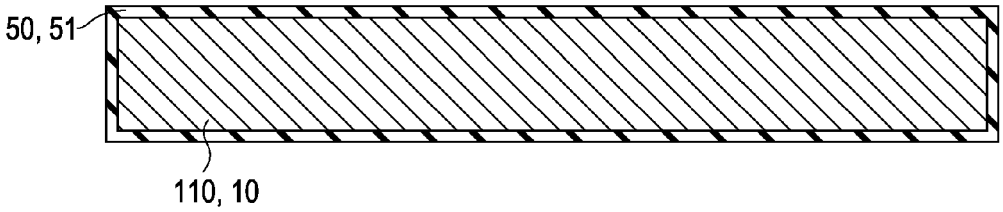
FIGS. 3A to 3C are cross-sectional views showing a manufacturing method of the recording head related to Embodiment 1 of the invention.

First, as shown in FIG. 3A, an oxide film 51 constituting the elastic film 50 is formed on the surface of a wafer for a flow path forming substrate, 110, which is a silicon wafer and in which a plurality of flow path forming substrates 10 is integrally formed.

Figure 3B:
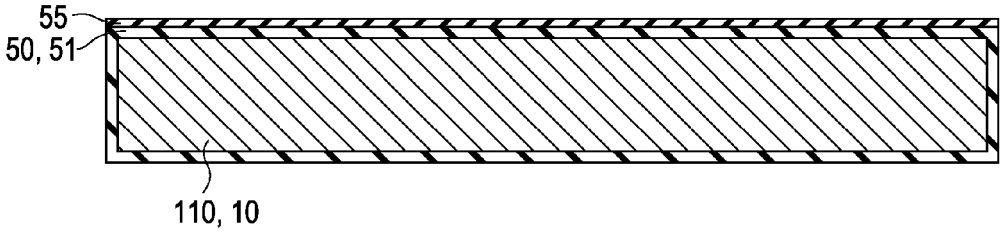

Then, as shown in FIG. 3B, the insulator film 55 which is made of an oxide film of a different material from the elastic film 50 is formed on the elastic film 50 (oxide film 51).

Figure 3C:
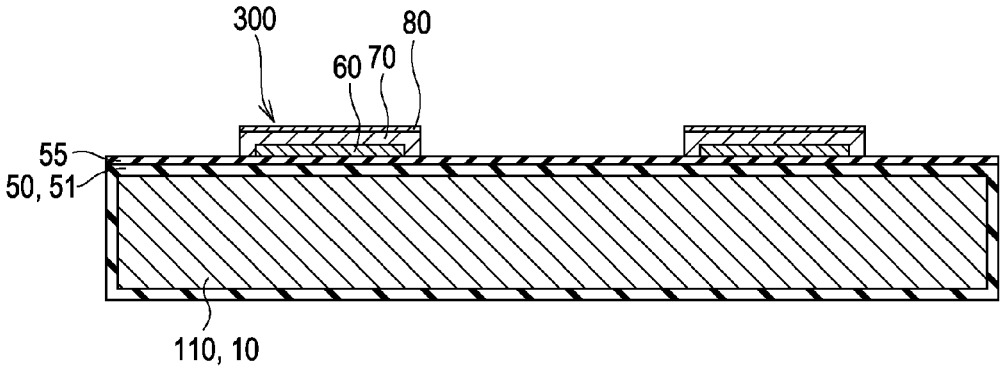

Next, as shown in FIG. 3C, the piezoelectric element 300 is formed by sequentially laminating and forming the first electrode 60, the piezoelectric body layer 70, and the second electrode 80, and also patterned into a given shape.

Figure 4A:
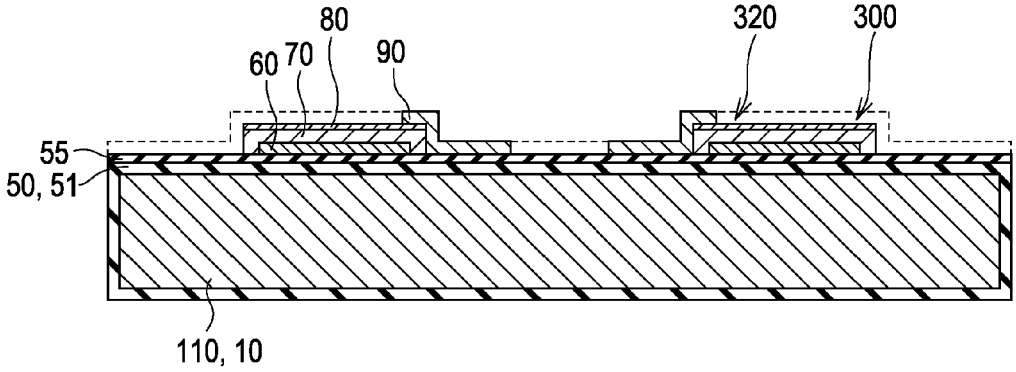
FIGS. 4A and 4B are cross-sectional views showing the manufacturing method of the recording head related to Embodiment 1 of the invention.

Next, as shown in FIG. 4A, the lead electrode 90 which is made of, for example, gold (Au) or the like is formed over the entire surface of the wafer for a flow path forming substrate, 110, and then, patterned for every piezoelectric element 300 through a mask pattern (not shown) which is made of, for example, resist or the like.

Figure 4B:
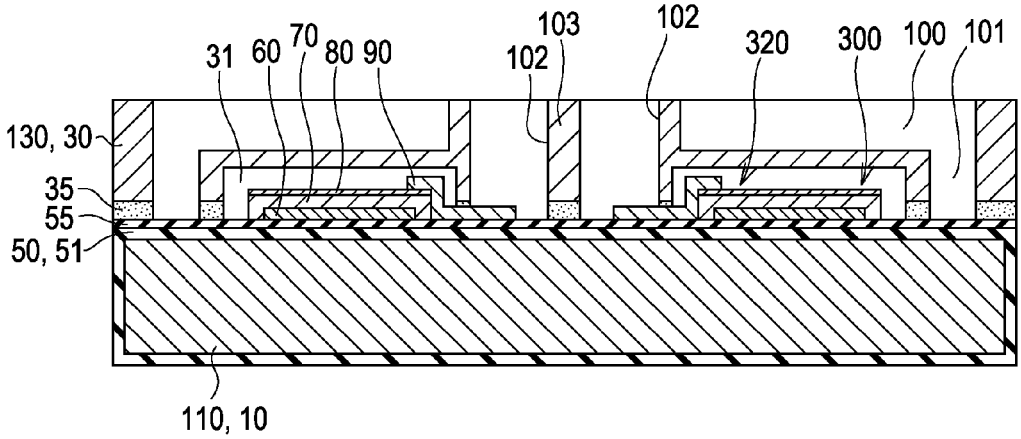

Next, as shown in FIG. 4B, a wafer for a protective substrate, 130, is bonded on the wafer for a flow path forming substrate, 110, by the adhesive 35. Here, at the wafer for a protective substrate, 130, the piezoelectric element retention portions 31, the manifolds 100, the supply portions 101, the through-hole 102, the partition wall 103, etc. are formed in advance. In addition, since the wafer for a protective substrate, 130, is relatively thick, rigidity of the wafer for a flow path forming substrate, 110, is significantly improved by joining the wafer for a protective substrate, 130.

Figure 5A:
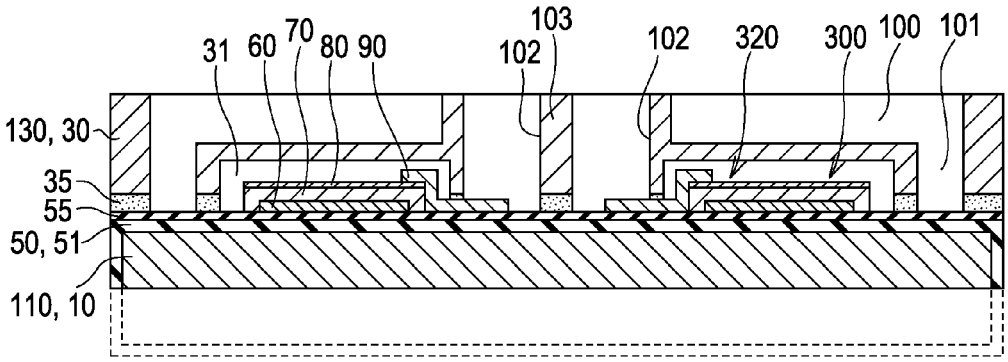
FIGS. 5A to 5C are cross-sectional views showing the manufacturing method of the recording head related to Embodiment 1 of the invention.

Next, as shown in FIG. 5A, the wafer for a flow path forming substrate, 110 is thinned to a given thickness.

Figure 5B:
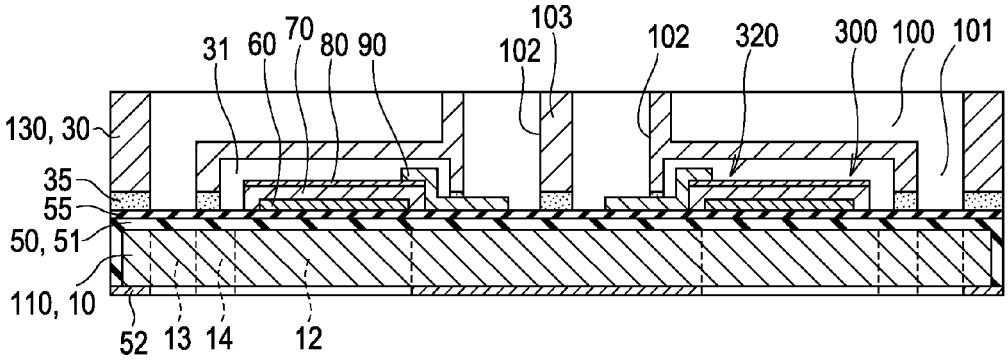
Figure 5C:
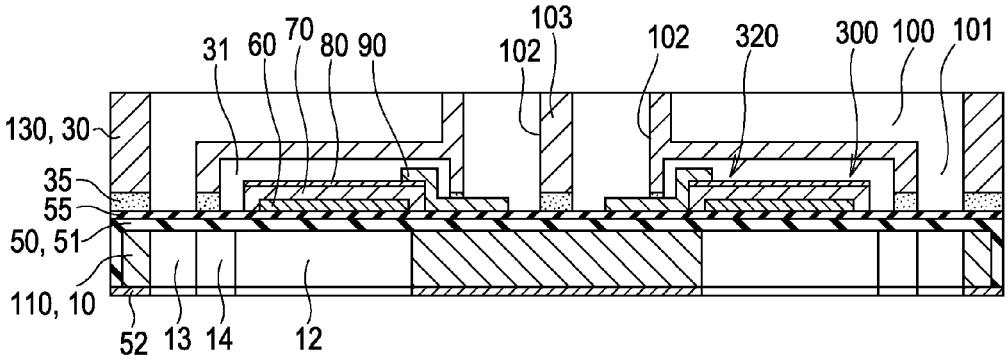

Next, as shown in FIG. 5B, a mask film 52 is newly formed on the wafer for a flow path forming substrate, 110, and then, patterned into a given shape. Then, as shown in FIG. 5C, the pressure generation chambers 12, the communication paths 13, the ink supply paths 14, etc. are formed by etching the wafer for a flow path forming substrate, 110, through the mask film 52 by anisotropic etching (wet etching) using alkali solution such as KOH.

In addition, when the individual flow paths are formed in the wafer for a flow path forming substrate, 110, it is preferable to seal the surface on the opposite side to the wafer for a flow path forming substrate, 110, of the wafer for a protective substrate, 130, by a sealing film which is made of a material having alkali resistance, for example, PPS (polyphenylene sulfide), PPTA (polyparaphenylene terephthal amide), or the like. Also, in this embodiment, a configuration is made such that the manifolds 100 and the supply portions 101 are provided in advance at the wafer for a protective substrate, 130. However, the invention is not particularly limited to this, but, for example, a configuration may also be made such that after the joining of the wafer for a flow path forming substrate, 110, and the wafer for a protective substrate, 130, when the pressure generation chambers 12, etc. are formed by wet-etching the wafer for a flow path forming substrate, 110, at the same time, the manifolds 100 and the supply portions 101 are formed by wet-etching. According to this, a manufacturing process is simplified, so that a cost can be reduced.

In addition, two through-holes 102 and the partition wall 103 partitioning the through-holes 102 are provided in the protective substrate 30 (the wafer for a protective substrate, 130) of this embodiment. However, since the partition wall 103 does not protrude to the opposite side to the wafer for a flow path forming substrate, 110, of the wafer for a protective substrate, 130, when the wafer for a protective substrate, 130, is joined to the wafer for a flow path forming substrate, 110, the wafers can be pressed at a uniform pressure in a plane of the joined surface. Therefore, the breaking of the wafer for a protective substrate, 130, the wafer for a flow path forming substrate, 110, or the like is suppressed, so that yield can be improved, and also the joint strength of the two is improved, so that quality such as durability can be improved.

Figure 6A:
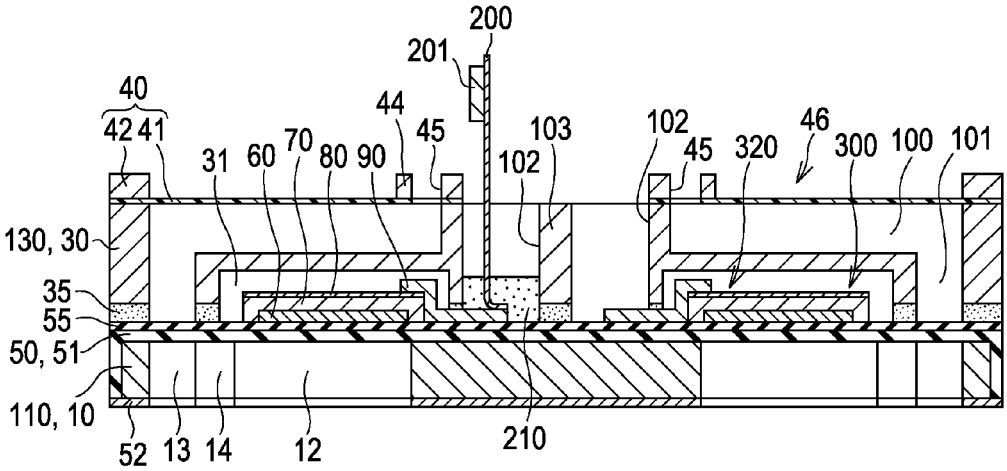
FIGS. 6A and 6B are cross-sectional views showing the manufacturing method of the recording head related to Embodiment 1 of the invention.

Next, as shown in FIG. 6A, the compliance substrate 40 is joined to the wafer for a protective substrate, 130, and then the wiring substrate 200 (wirings (not shown)) is electrically connected to one row of lead electrodes 90 of the piezoelectric elements 300, which are exposed in one through-hole 102. The joining of the wiring substrate 200 and the lead electrodes 90 is performed through the anisotropic electrically-conductive adhesive 210. Specifically, after the through-hole 102 is filled up with the anisotropic electrically-conductive adhesive 210, the wiring substrate 200 is joined to the lead electrodes 90 by performing heating while pressing the wiring substrate 200 against the lead electrodes 90. In addition, when performing heating while pressing the wiring substrate 200 against the lead electrodes 90, a mounting tool which is brought into contact with the back of the wiring substrate 200 is used.

At the time of such connection of the wiring substrate 200 and the lead electrodes 90, since adjacent through-holes 102 are partitioned by the partition wall 103, it can be suppressed that the anisotropic electrically-conductive adhesive 210 which connects the wiring substrate 200 and the lead electrodes 90 flows out to the neighboring through-hole 102 side, in which connection is not performed.

Figure 6B:
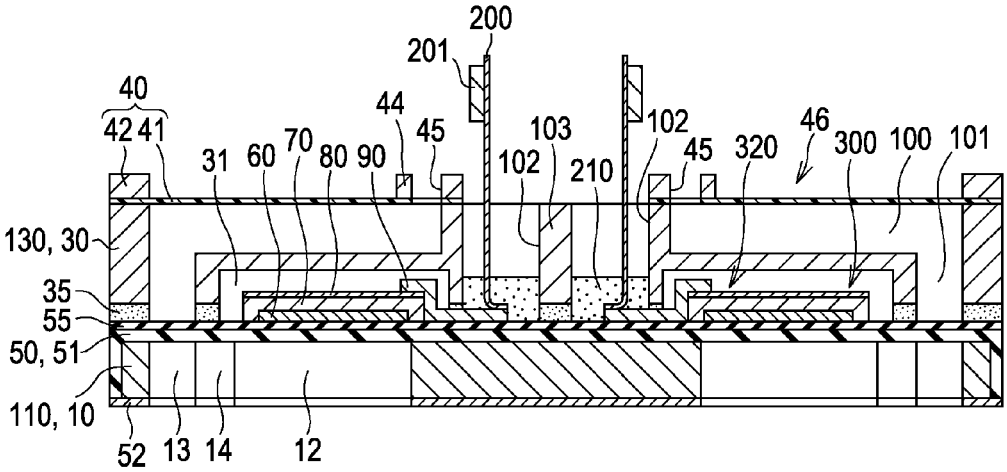

Next, as shown in FIG. 6B, the wiring substrate 200 is electrically connected to the other row of lead electrodes 90 of the other piezoelectric elements 300, which are exposed in the other through-hole 102. At this time, since the anisotropic electrically-conductive adhesive 210 used when connecting the wiring substrate 200 of one side does not flow out into the other through-hole 102, the excellent connection of the other row of lead electrodes 90 and the wiring substrate 200 can be made. That is, in a process shown in FIG. 6A, in a case where the anisotropic electrically-conductive adhesive 210 used in the inside of one through-hole 102 flows out into the other through-hole 102, the anisotropic electrically-conductive adhesive 210 flowed into the other through-hole 102 is hardened, so that there is a fear that an excellent connection of the lead electrodes 90 and the wiring substrate 200 cannot be made.

In addition, in a process before or after the connection of the wiring substrate 200, unnecessary portions of outer peripheral portions of the wafer for a flow path forming substrate, 110, and the wafer for a protective substrate, 130, are removed by cutting them by, for example, dicing or the like, and the nozzle plate 20 with the nozzle orifices 21 perforated therein is joined to a face on the opposite side to the wafer for a protective substrate, 130, of the wafer for a flow path forming substrate, 110. Then, by dividing the wafer for a flow path forming substrate, 110, etc. into the flow path forming substrate 10 of one chip size as shown in FIG. 1, etc., the ink jet type recording head I of this embodiment is manufactured. Of course, a configuration may also be made such that the compliance substrate 40 is also fixed after the connection of the wiring substrate 200.

Other Embodiments

Figure 7:
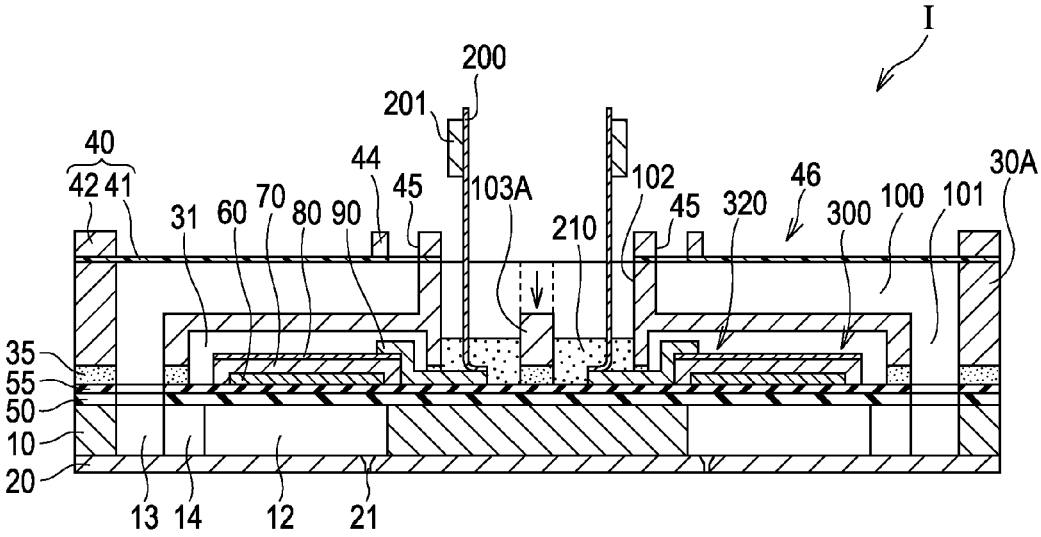
FIG. 7 is a cross-sectional view of a recording head related to another embodiment of the invention.

Although one embodiment of the invention has been described above, the basic configuration of the invention is not to be limited to the aforementioned. For example, in Embodiment 1 described above, the partition wall 103 which partitions two through-holes 102 is made to have the same thickness as the protective substrate 30. However, the invention is not particularly limited to this. Here, another example of the protective substrate is shown in FIG. 7. In addition, FIG. 7 is a cross-sectional view showing an ink jet type recording head related to another embodiment of the invention. As shown in FIG. 7, a partition wall 103A of a protective substrate 30A is formed to be lower than the surface of the protective substrate 30A on the opposite side of the flow path forming substrate 10. Therefore, a mounting tool which performs heating and pressing when connecting the wiring substrate 200 and the lead electrodes 90 in each through-hole 102 is easily inserted into the through-hole 102, so that working hours can be shortened, and also mounting stability of the wiring substrate 200 and the lead electrodes 90 can be improved.

Also, in Embodiment 1 described above, the wiring substrate 200 and the lead electrodes 90 which are the mounting portions are electrically connected (mounted) by the anisotropic electrically-conductive adhesive 210. However, the invention is not particularly limited to this, but, for example, the wiring substrate 200 and the lead electrodes 90 may also be connected by using metal such as solder. In this case, after the wiring substrate 200 and the lead electrodes 90 are connected by using metal, the through-hole 102 may be filled with resin which is composed of a potting agent. The filling of the through-hole 102 with the potting agent needs to be performed immediately after the wiring substrate 200 and the lead electrodes 90 are connected by using metal. This is because, for example, if the filling of the potting agent is performed late, a possibility that a foreign matter infiltrates into the connection portion of the wiring substrate 200 and the lead electrodes 90 is increased, so that there is a fear that trouble such as short-circuit of the wirings or trouble such as deviation of the wiring substrate 200 from the lead electrodes 90 will be generated. According to the invention, even if, after the connection of the wiring substrate 200 and the lead electrodes 90 in one through-hole 102, the through-hole 102 is filled with resin which is composed of a potting agent, the potting agent does not flow out into the other through-hole 102. Therefore, after one through-hole 102 is filled with the potting agent, the wiring substrate 200 and the lead electrodes 90 can be electrically connected in the other through-hole 102.

Further, in Embodiment 1 described above, one wiring substrate 200 is connected in one through-hole 102. However, the invention is not particularly limited to this, but, two or more wiring substrates 200 may also be connected to the mounting portion in one through-hole 102. Of course, the through-hole 102 may also be provided in a plurality of numbers corresponding to the number of the wiring substrates 200.

Also, for example, in Embodiment 1 described above, as an individual flow path, the pressure generation chamber 12, the ink supply portion 14, and the communication path 13 are provided. However, the invention is not particularly limited to this, but, for example, the communication path 13 may not be provided. Also, by independently providing the supply portion 101 for each individual flow path, it is also possible to make the supply portion 101 serve as an ink supply path which makes flow path resistance occur in ink between the pressure generation chamber 12 and the manifold 100. In this manner, in the case of making the supply portion 101 function as an ink supply path, the ink supply portion 14 and the communication path 13 may not be provided in the flow path forming substrate 10. Thus, only the pressure generation chamber 12 may be provided in the flow path forming substrate 10. Moreover, a width in the longitudinal direction of the pressure generation chamber 12 can be reduced, and also a cost can be reduced. Of course, a manifold portion, which is communicated with each individual flow path and constitutes a part of the manifold 100, and so on may also be provided in the flow path forming substrate 10. Also, the communication paths 13 may also be connected to each other in a row of the pressure generation chambers 12. According to this, a pressure loss up to the ink supply path 14 can be lowered.

In addition, in Embodiment 1 described above, the compliance substrate 40 is constituted by the sealing film 41 and the fixing plate 42, and the flexible portion 46 is formed by the opening portion 43 of the fixing plate 42. However, the invention is not particularly limited to this, but, for example, the flexible portion 46 and so on may also be formed by partially thinning the thickness of one piece of plate-like member.

Further, in Embodiment 1 described above, one flexible portion 46 is provided at the compliance substrate 40. However, the invention is not particularly limited to this, but, for example, a plurality of flexible portions 46 may also be provided by providing a plurality of opening portions 43 at the fixing plate 42.

Also, in Embodiment 1 described above, as an actuator device which makes a pressure change occur in the pressure generation chamber 12, the actuator device having the thin film type piezoelectric element 300 is used and explained. However, the invention is not particularly limited to this, but, for example, an actuator device having a thick film type piezoelectric element which is formed by a method of attaching a green sheet, or the like, an actuator device having the longitudinal vibration type piezoelectric element, in which a piezoelectric material and an electrode forming material are alternately laminated so that axial expansion or contraction occurs, or the like can be used. Also, as an actuator device, an actuator device, in which a heating element is disposed in the pressure generation chamber 12 and liquid droplets are discharged from a nozzle orifice by bubbles which are generated by heat generation of the heating element, or a so-called electrostatic actuator device, in which static electricity is generated between a vibration plate and an electrode and liquid droplets are discharged from a nozzle orifice by deforming the vibration plate by an electrostatic force, or the like can be used. Even if either actuator device is used, it is enough if the mounting portion is provided on the flow path forming substrate.

Figure 8:
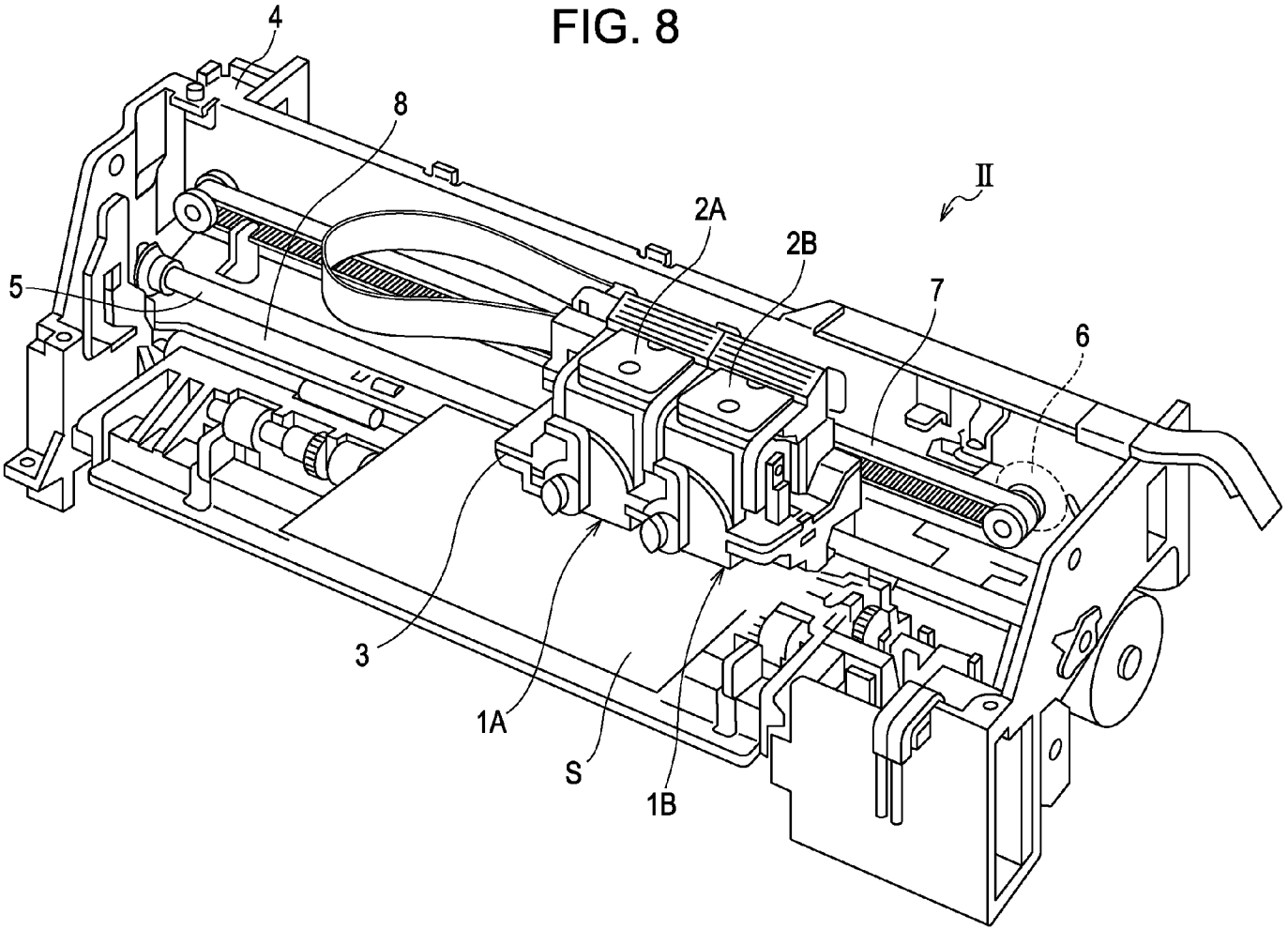
FIG. 8 is a schematic diagram of a recording apparatus related to one embodiment of the invention.

Further, the ink jet type recording head of each of these embodiments constitutes a part of a recording head unit having an ink flow path which is communicated with an ink cartridge and so on, and is mounted on an ink jet type recording apparatus. FIG. 8 is a schematic diagram showing one example of the ink jet type recording apparatus.

As shown in FIG. 8, an ink jet type recording apparatus II has recording head units 1A and 1B each having the ink jet type recording head. Then, cartridges 2A and 2B constituting ink supply sections are detachably mounted on the recording head units 1A and 1B, and a carriage 3 on which the recording head units 1A and 1B are mounted is provided to be movable in an axial direction on a carriage shaft 5 attached to an apparatus main body 4. The recording head units 1A and 1B are made to discharge, for example, a black ink composition and a color ink composition, respectively.

Then, the carriage 3 on which the recording head units 1A and 1B are mounted is moved along the carriage shaft 5 by the driving force of a drive motor 6, which is transmitted to the carriage 3 through a plurality of gears (not shown) and a timing belt 7. On the other hand, a platen 8 is provided along the carriage shaft 5 in the apparatus main body 4, and a recording sheet S, which is a recording medium such as paper and is fed by a paper feed roller (not shown) and so on, is wound around the platen 8 and transported.

Further, the invention broadly targets liquid ejecting heads in general and can also be applied to, for example, various recording heads such as an ink jet type recording head which is used in an image recording apparatus such as a printer, a color material ejecting head which is used for the manufacturing of a color filter for a liquid crystal display or the like, an electrode material ejecting head which is used for the formation of an electrode for an organic EL (electroluminescence) display, a FED (Field Emission Display), or the like, a biological organic matter ejecting head which is used for the manufacturing of a bio-chip, or the like.

Also, although the ink jet type recording apparatus II has been used and described as one example of the liquid ejecting apparatus, the invention can also be applied to liquid ejecting apparatuses which use other liquid ejecting heads described above.

What is claimed is:

1. A liquid ejecting head comprising:

a flow path forming substrate;

an actuator device having a plurality of mounting portions provided on the flow path forming substrate;

a wiring substrate which has flexibility and is electrically connected to the mounting portions to supply a driving signal to the actuator device; and a protective substrate provided on the mounting portions side of the flow path forming substrate, wherein a plurality of through-holes, into which the wiring substrate can be inserted, is provided in the protective substrate, a partition wall partitioning the mounting portions is provided between at least adjacent through-holes, resin is provided in the through-holes, the partition wall is configured to suppress an outflow of the resin between the adjacent through-hole, and the mounting potions are buried under the resin.

2. The liquid ejecting head according to claim 1, wherein individual flow paths are provided at the flow path forming substrate, and a manifold which is communicated with a plurality of individual flow paths is provided on the opposite side to the flow path forming substrate of the actuator device.

3. The liquid ejecting head according to claim 1, wherein the resin is an anisotropic electrically-conductive adhesive having anisotropic conductivity.

4. The liquid ejecting head according to claim 1, wherein the resin is composed of a potting agent.

5. A liquid ejecting apparatus comprising:

a liquid ejecting head that includes:

a flow path forming substrate;

an actuator device having a plurality of mounting portions provided on the flow path forming substrate;

a wiring substrate which has flexibility and is electrically connected to the mounting portions to supply a driving signal to the actuator device; and a protective substrate provided on the mounting portions side of the flow path forming substrate, wherein a plurality of through-holes, into which the wiring substrate can be inserted, is provided in the protective substrate, a partition wall partitioning the mounting portions is provided between at least adjacent through-holes, resin is provided in the through-holes, the partition wall is configured to suppress an outflow of the resin between the adjacent through-hole, and the mounting potions are buried under the resin.

6. The liquid ejecting apparatus according to claim 5, wherein individual flow paths are provided at the flow path forming substrate, and a manifold which is communicated with a plurality of individual flow paths is provided on the opposite side to the flow path forming substrate of the actuator device.

7. The liquid ejecting apparatus according to claim 5, wherein the resin is an anisotropic electrically-conductive adhesive having anisotropic conductivity.

8. The liquid ejecting apparatus according to claim 5, wherein the resin is composed of a potting agent.

* * * * *